US005083666A

United States Patent [19]

Lam

[11] Patent Number: 5,083,666

[45] Date of Patent: Jan. 28, 1992

[54] CRATES FOR TRANSPORTING RUBBER BLOCKS OR SHEETS

[76] Inventor: David C. S. Lam, Singapore, Singapore

[21] Appl. No.: 355,747

[22] Filed: May 23, 1989

[51] Int. Cl.[5] ..... B65D 21/06

[52] U.S. Cl. ..... 206/506; 206/503

[58] Field of Search ..... 206/506

[56] References Cited

U.S. PATENT DOCUMENTS

| | | | |
|---|---|---|---|
| 2,134,875 | 11/1938 | Henze | 206/506 |
| 2,224,681 | 12/1940 | Hovorka | 206/506 |
| 2,494,503 | 1/1950 | Best | 206/506 |
| 2,545,758 | 3/1951 | Best | 206/506 |
| 2,609,120 | 9/1952 | Williams | 206/506 |
| 2,765,099 | 10/1956 | Lively | 206/506 |
| 2,783,915 | 3/1957 | Gordon | 206/506 |
| 4,423,813 | 1/1984 | Kreeger | 205/506 |

FOREIGN PATENT DOCUMENTS

| | | | |
|---|---|---|---|
| 575545 | 5/1959 | Canada | 206/506 |
| 3521894 | 1/1987 | Fed. Rep. of Germany | 206/506 |
| 1131651 | 2/1957 | France | 206/506 |
| 1269427 | 7/1961 | France | 206/506 |
| 7905105 | 12/1980 | Netherlands | 206/506 |
| 119073 | 3/1970 | Norway | 206/506 |
| 1016099 | 1/1966 | United Kingdom | 206/506 |
| 1574117 | 9/1980 | United Kingdom | 206/506 |
| 2177377 | 1/1987 | United Kingdom | 206/506 |

*Primary Examiner*—Stephen Marcus
*Assistant Examiner*—Paul A. Schwarz
*Attorney, Agent, or Firm*—Nixon & Vanderhye

[57] ABSTRACT

Crates (1) for use in transporting a load of blocks or sheets of rubber having hinged support members (12) mounted in the rim (4). The members (12) include a hinged blade (14). Filled crates can be supported one on top of the other(s) in a stack with the blade (14) arranged to support the overlying crate. Empty crates can be nested in a compact condition with the blade (14) protruding slightly outwardly.

3 Claims, 4 Drawing Sheets

CRATES FOR TRANSPORTING RUBBER BLOCKS OR SHEETS

This invention relates to crates for transporting blocks or sheets of rubber or like material, by sea, rail or air.

Traditionally, rubber sheets or blocks are packed into wooden crates. These crates have to be large enough to accommodate 30 to 36 rubber blocks or sheets made according to an international packing standard or to dimensions of approximately 700 mm long×355 mm wide×180 mm thick. Since one such block or sheet weighs about 33 to 35 kg, each wooden crate is required to withstand a packing load of 1 to 1.26 tones. The crates, therefore, have overall dimensions of approximately 1100 mm high×1130 mm wide×1447 mm long.

A wooden crate sufficiently robust to carry the above load and to withstand the forces of sea transport and rough port handling requires a substantial quantity of timber. This means that the volume of the timber itself substantially increases the total volume required in the hold of the ship, to accommodate the crate and its load, over and above the volume of the load itself. Clearly, this leads to the disadvantage that the timber crates put a restriction on the quantity of cargo which can be shipped at any given time. The crates are usually disposed of at their destination port because it is not economic to return empty crates from the destination port to the loading port. This is because the crates would take up the same space in the hold of the ship on their return journey as they would on their outgoing journey.

It is one object of the invention to provide a crate for use in transporting a load of rubber or the like and which can be stacked with other such filled crates to form a column for transport from the loading port and which when empty can be nested in another such empty crate for economic return to the loading port.

GB patent publication 2180820 (LAM) discloses a nestable crate for packing blocks or sheets of rubber. The base of the crate preferably includes retractable members to be extended laterally for stability and to support one filled crate on top of another.

This invention is based on the realization that if moveable support members are mounted in the rim of the crate the filled crates are then better able to be stacked and the empty crates better able to be nested.

According to one aspect of the invention, there is provided a crate for the purpose specified, the crate having a base and upwardly outwardly flaring sidewalls which end in a rim, at least one support member being hingedly connected to the rim, the hinged support member being pivotally movable from one condition in which the member extends towards the opposite sidewall of the crate when filled so that an overlying filled such crate can be received in the rim of the crate with the member aiding in the support of the overlying crate, and a second condition in which the member extends outwardly downwardly from the rim so that the overlying empty crate may be nested in the crate with the base of the overlying crate adjacent that of the crate.

Preferably, a plurality of hinged support members is present, each located at or adjacent a corner of a crate which is preferably rectangular in section. The rim is preferably of rectangular section. The hinged support member preferably comprises a support blade hingedly mounted between a pair of supports having substantially the same cross-sectional shape as the rim. The support blade is preferably hinged about an axis parallel to the longitudinal axis of the rim such that when in the second position, it can lie substantially vertically and extend outwardly downwardly between the supports so that the support blade does not extend substantially laterally outwardly from the side of the crate.

In another aspect, the invention provides a column or stack of filled crates of the invention, each crate containing blocks or sheets of rubber, the rubber having been allowed to settle until the level thereof is below the rim of the respective crate, the hinged support member being in the one condition and extending towards the centre of the crate and in contact with the upper surface of the load, the base of each overlying crate resting on the hinged support member of the underlying crate.

Preferably the crates are dimensioned such that when one filled crate is received in another, the rim of the receiving crate provides lateral support for the received crate.

In another aspect the invention provides a method of making such a column or stack comprising locating the hinged support member in the second condition, filling the crate with blocks or sheets of rubber, allowing the load to settle until the dunnage is complete, moving the hinged support member to the one condition and placing another such crate thereon with the base of the overlying crate in contact with the hinged support member of the underlying crate.

It is an advantageous feature of the invention that because of the shape of the crate the period to allow the rubber to settle is about 2 to 4 hours.

In another aspect, the invention provides a column of empty crates of the invention, one crate being received in another, the hinged support members of each being in the second condition, the base of the upper crate being spaced from the floor of the lower crate, the upper crate extending above the lower by a height substantially equal to that of the rim.

The packing density enables more empty crates to be packed into a given volume of space in the hold of a ship, thereby making the cost of returning empty crates more economic.

Preferably, the crate has a side wall formed of flat bar members which has the advantage that even if the bars become slightly damaged or crooked through use, the nesting of the crates would not be impeded. The side wall is preferably open sided to help to reduce the overall weight of the crates to about 85 kg which is comparable to the weight of wooden crates.

Feet may be positioned in the vicinity of each corner of the base, the spacing between each of the feet being such that forks of a fork lift truck can be received between them.

The height of the rim is preferably substantially equal to the height of the feet so that when one crate is nested within another, the nested crate protrudes from the nesting crate by a distance substantially equal to the height of the rim.

Crates of the invention are advantageous in that the hinged support members can very easily be flipped by hand from the second condition which enables stacking of the crates, and the one condition which allows nesting of the crates to the optimal packing density.

The invention will now be further described by way of example with reference to the accompanying drawings in which.

Figure 1:
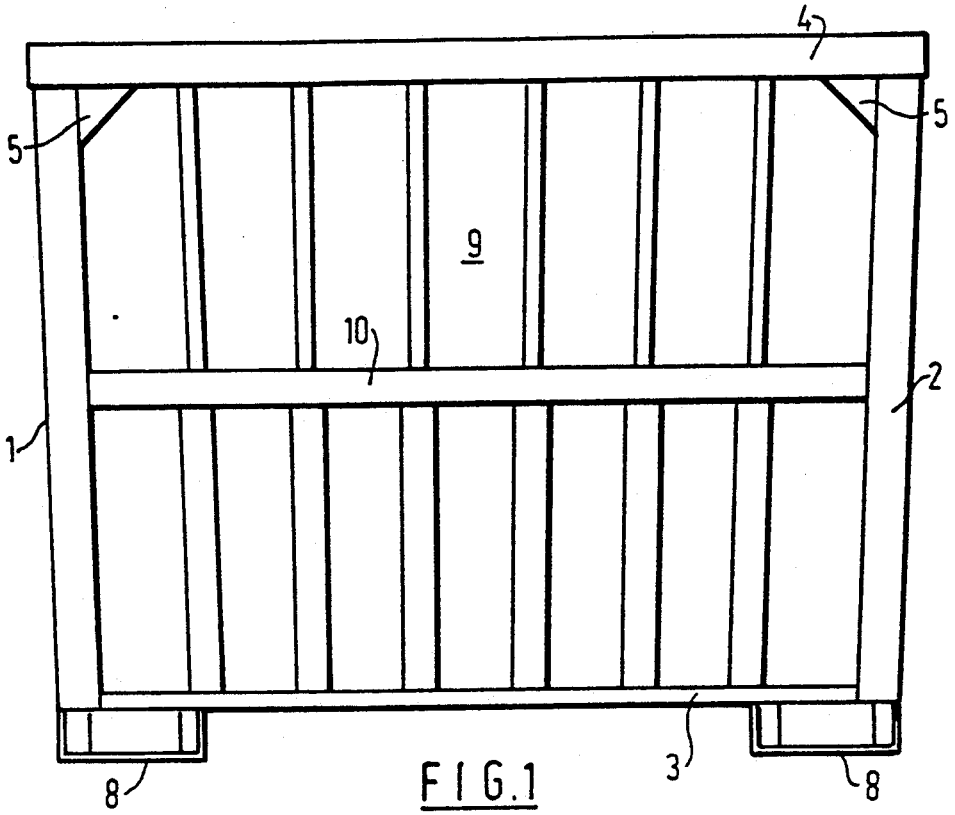
FIG. 1 is a side elevation of one crate of the invention.
Figure 2:
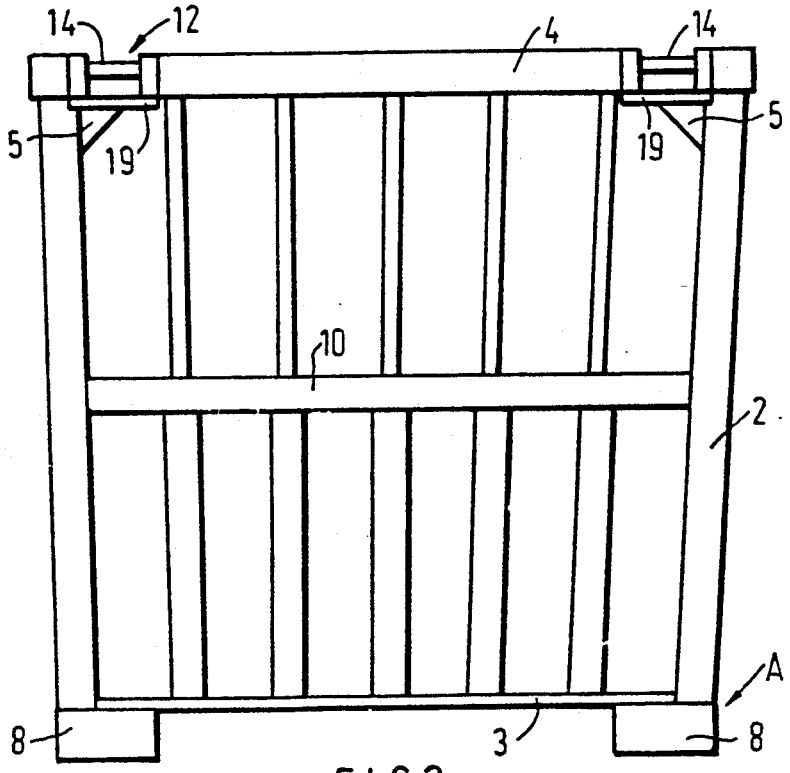
FIG. 2 is an end elevation of the crate of FIG. 1.
Figure 6A:
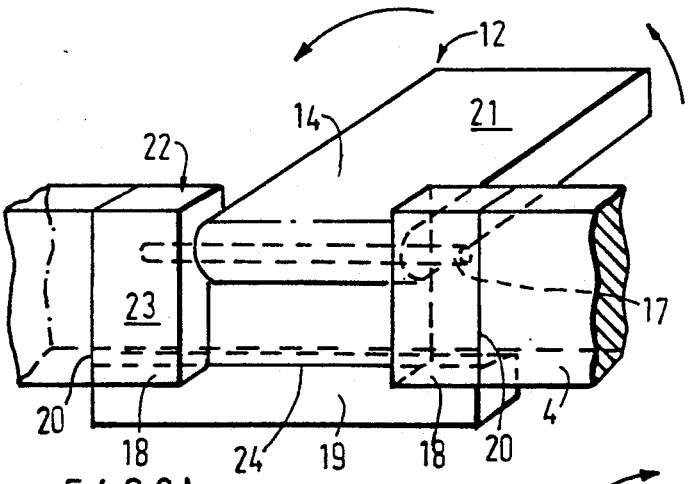
Figure 6B:
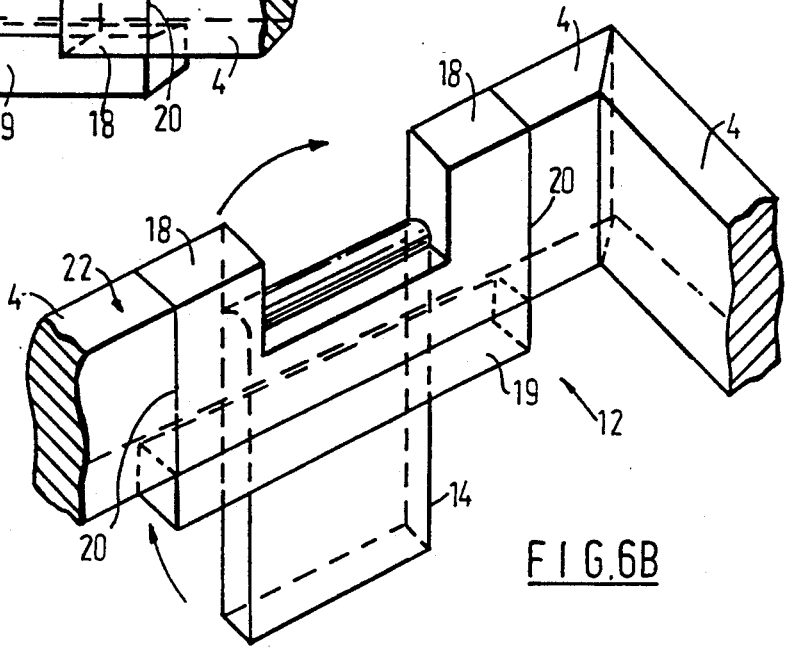
Figure 7:
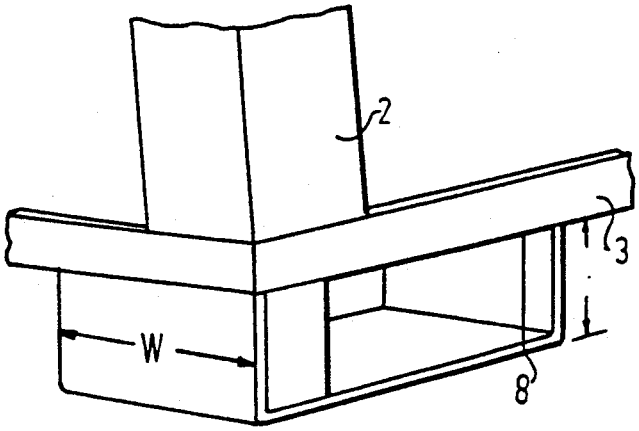
Figure 8:
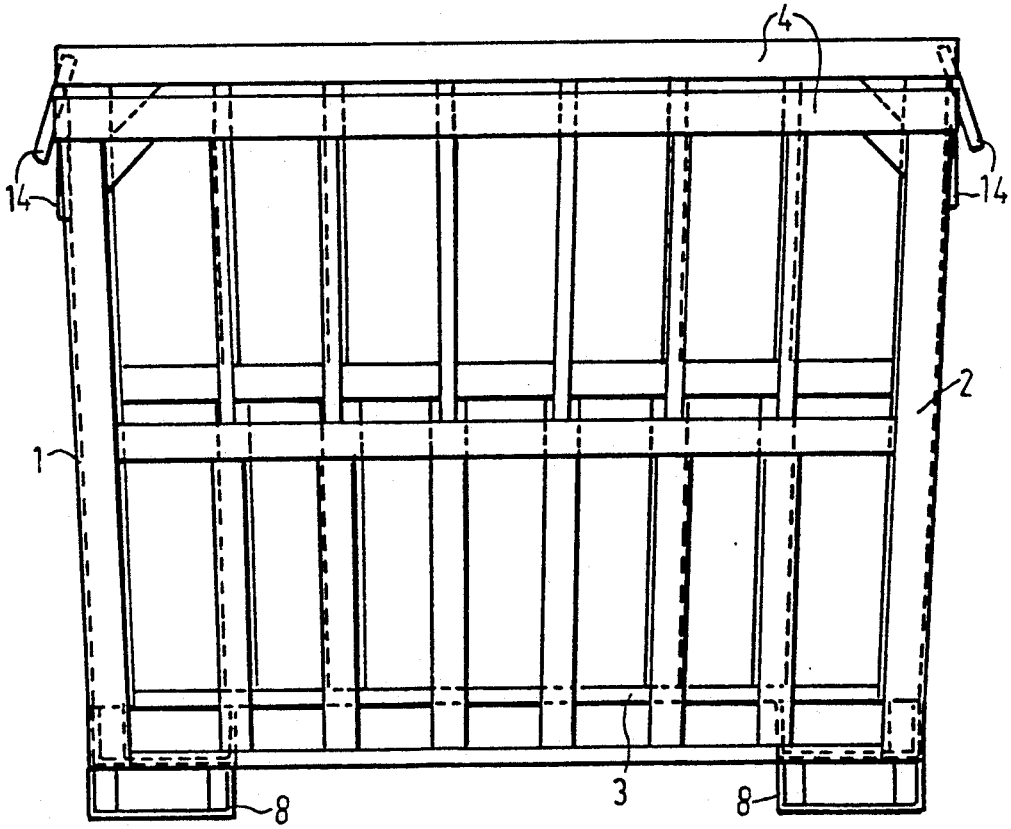

FIGS. 6*a* and 6*b* are enlarged fragmentary views of a hinged support member in 'stacking' and 'nesting' positions respectively;

FIG. 7 is an enlarged fragmentary perspective view of a foot of the crate taken in the direction of arrow A of FIG. 2; and FIG. 8 shows one empty crate nested within another such crate.

A crate 1 comprises a framework of generally L cross-section members comprising uprights 2 and base members 3 with a rim 4 joining the upper ends of the uprights 2. The rim 4 may be in the form of a board or the like 65 mm in height. Corner gussets 5 are provided between the uprights 2 and the rim 4 for additional strength. The crate is rectangular in section and frusto-pyramidal in elevation, i.e. flaring upwardly away from the base so that one crate will nest inside another, as explained below.

The crate has a base 7 which is substantially flat, and constructed from metal or a strong plastics material, about 2 mm thick. A foot 8 is present at each corner of crate 1. Forks, not shown, of a fork lift truck may pass under the base 7 and between pairs of feet 8 from any side of the crate. Consequently, the crate 1 can be lifted, by a fork lift truck, without the need to consider the orientation of the crate. FIG. 7 illustrates a perspective view of one of the feet 8. The height H of the foot 8 is preferably a little greater than the thickness of a fork of a fork lift truck and the width W of the foot 8 is such that it can rest upon the surface 21 of a corresponding blade 14, as explained below.

The sides of the crate comprise a wall structure 9 which is formed from a row of substantially vertically orientated flat bars. The rows are separated by a horizontal bar 10 which extends between the upright members 2 of each side of the crate 1. The bars of the upper row are narrower than those of the lower row to save weight and cost. The lower bars are wider in order to withstand greater sideways forces due to the weight of the rubber blocks or sheets within the crate. The top row of bars may each be approximately 25 mm in width and the bars of the lower row and the horizontal bar may each be approximately 43 mm in width. The upright members 2 are formed from metal bar about 3 mm thick, a thickness which is significantly less than this (say 1 mm) may not be suitable as the uprights 2 may then not be strong enough to support several stacked crates together weighing 6 tons. If the uprights are significantly thicker than 3 mm, i.e. 6 mm say, then the nesting depth of a nested crate may be less, which may lead to a reduction in the packing density of nested crates.

The vertically orientated bars may taper, that is reduce in width towards the base of the crate. This tapering would have the effect of reducing interference, particularly if some bars are buckled, between the bars of respective crates when one crate is nested within another.

Hinged support members 12 are positioned in the rim 4 close to each of the four corners of crate 1. As shown in FIGS. 6*a* and 6*b* each hinged support member 12 comprises a blade 14, approximately 88 mm wide, which hinges about a pin 17 which passes through or is welded adjacent to one end face of the blade 14 and extends into a pair of hinge supports 18. The hinge supports 18 are strengthened by bridging rib 19 which is formed integrally by casting or is welded at the bottom of the supports 18. The supports 18 are joined, e.g. welded at 20 into a recess in the rail 4. The hinged support member 12 is located at the corner of the crate for maximum strength. The member 2 of L-cross section absorbs some of the load and prevents the rim 4 from undergoing distortion when the crate is subjected to heavy loads.

The pin 17 is located and the blade 14 dimensioned relative to the recess 24 defined by the supports 18 and the rib 19 such that the blade can pass through the recess 24 without extending laterally outwardly of the rim 4 (see FIGS. 6*b* and 8). The blades 4 can be flipped by hand from one condition to the other.

Figure 3:
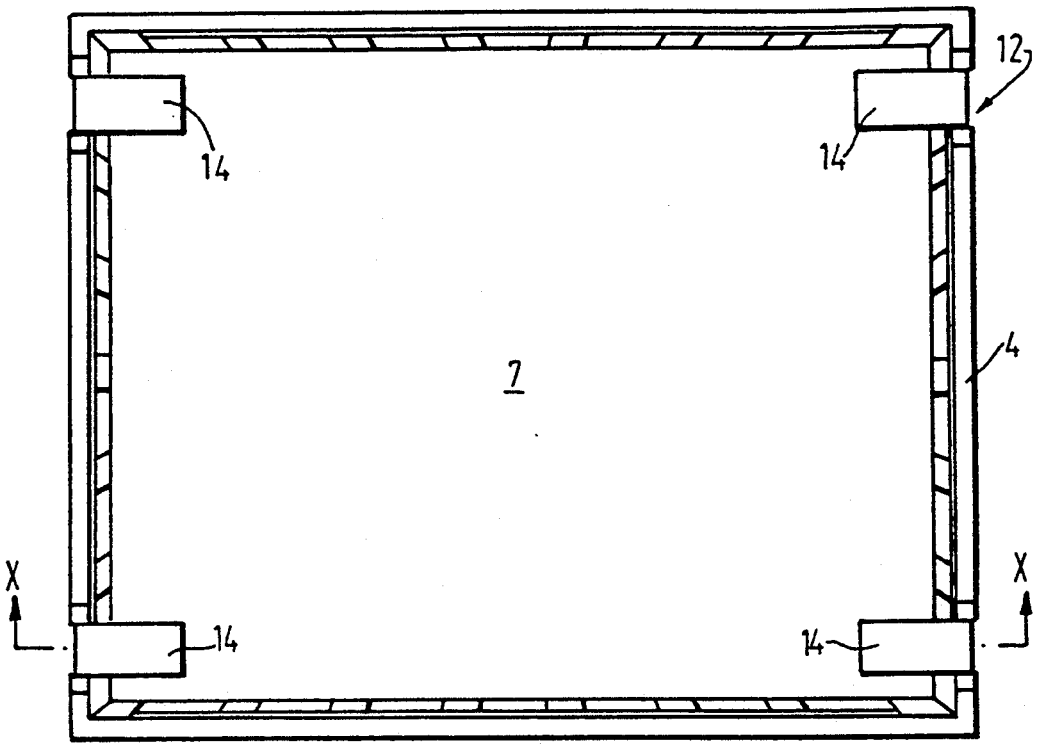
FIG. 3 is a plan view of the crate of FIG. 1 in one condition.
Figure 4:
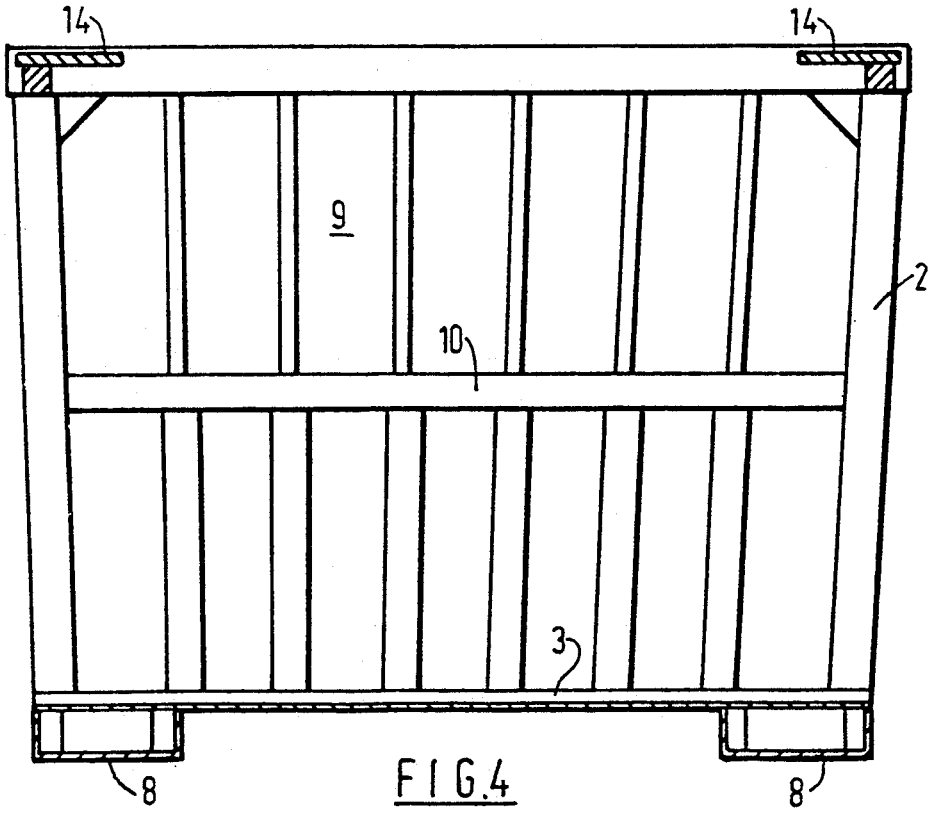
FIG. 4 is a cross-sectional view along the line X—X on FIG. 3 and showing one filled crate stacked on another.
Figure 5:
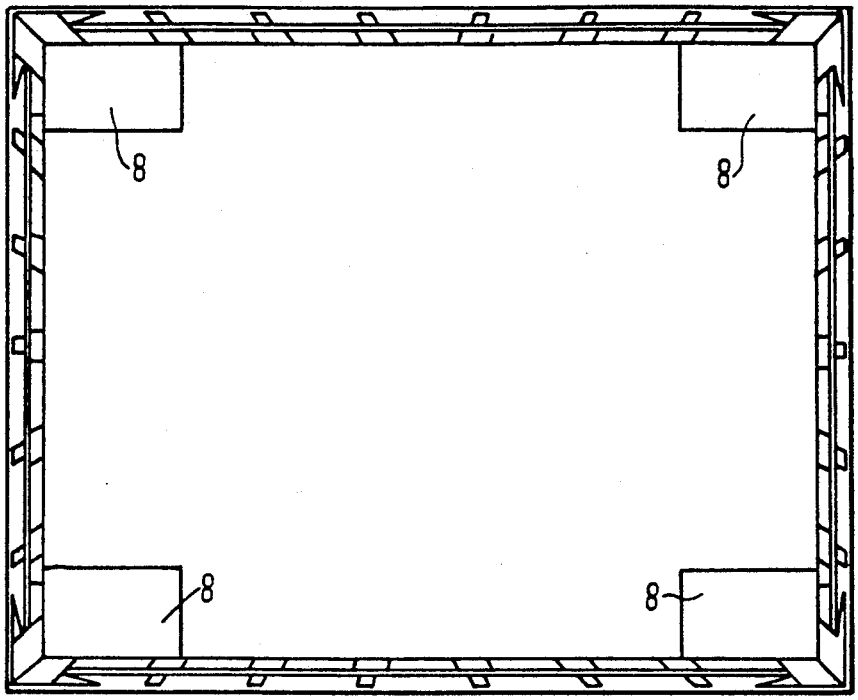
FIG. 5 is an underneath plan view of the crate of FIG. 1.

When the crates are initially loaded, there is space around the rubber blocks or sheets. Since the rubber slowly creeps, it takes up this space during the course of time. To ensure that as much rubber is carried by the crate at any one time, it is necessary initially to load the crate so that the level of rubber blocks protrudes above the top of the crate. Placement of dunnage is achieved by loading the crate with 1 to 3 tons and leaving the load in position for a period of 2 to 4 hours. Spaces then fill owing to flow or creeping of the rubber blocks. This process acts as dunnage for the crates and serves to steady the load during shipping as well as to improve load capacity of the crates. When dunnage is complete, the level of the rubber in the crate is not higher than the top of the crate. This allows the crates to be stacked. FIG. 3 illustrates the condition of the hinged support members 12 when they are extending towards one another across the load within the crate 1. In this position, the hinged support members 12 can support the base of another crate stacked on top of the crate 1, (even when the lower crate is empty) the blades 14 being located to receive the feet 8 of the overlying crate. The upper surface 21 of the blade 14 is about 20 mm below the upper surface 22 of the rim 4 which provides lateral support for stacked crates. In this position, the hinged support 12 does not extend beyond the outer edge 23 of the rim 4. This enables the rims of adjacent crates to butt up against each other without interference to enable optimal loading in the hold of the ship, container or rail car. This feature is significant when it is considered that hundreds or thousands of crates may be loaded in a ship's hold or container or rail car at any one time.

The crate is intended for transporting 30 to 40 rubber blocks or sheets having sizes of the order of magnitude 700 mm long×355 mm wide×180 mm thick, and consequently, is preferably of dimensions corresponding approximately to a height of 1100 mm, a width of 1130 mm and a length of 1447 mm. The construction of crate is such that it can withstand not only a load of rubber of approximately 1 to 1.26 tones, but also up to 4 to 6 stacked loaded crates one on top of another, and for shipping times of, for example, 50 days.

Crates embodying the invention are also very advantageous for the transporting of the rubber blocks or sheets because they facilitate faster loading and unloading of the rubber.

FIG. 8 illustrates a pair of nested empty crates 1. The thickness of material used to construct the crate, and the relative dimensions of the feet 8 and rim 4 are such as to provide optimal nesting of the crates. That is to say, the nested crate protrudes from the top of the receiving crate by a height substantially equal to the thickness of the rim 4. The blades 14 of the stacked crate protrude a little from the side of the crate 1 owing to the relative positions of the respective rims 4 of the nested and nesting crates 1. This extent of outward lateral protrusion is minimized by virtue of the configuration of hinged support members 12. The extent of protrusion can be made as low as, for example, 15 mm thereby enabling optimal packing of nested crates in the hold of a ship, container or rail car.

The invention is not limited to the embodiment illustrated. Thus the shape of the blade and the means of holding it in the rim of the crate can be varied, as may the disposition and number of the blades. The dimensions of the blade can also be varied.

I claim:

1. A crate having a base, upwardly and outwardly flared sidewalls extending continuously and uniformly from said base, a floor surface within said sidewalls providing a top portion of said base, four sidewalls and four corners, and a rim, said rim comprising the upper termination of said sidewalls, and having a width, height, and thickness;

four support members, one located adjacent each corner of said crate;

means for mounting each of said support members for pivotal movement with respect to said rim at a sidewall from a first portion, in which each of said support members extend interiorly of said rim toward another sidewall so that each of said support members will support the base of another crate when placed on top of each of said support members, and a second position in which each of said support members extend downwardly on the exterior of said sidewalls to allow nesting of said crate with other crates; and said means for mounting each of said support members comprising hinge means completely contained within the thickness of said rim; and each of said support members and hinge means having a thickness less than the width of said rim; and said sidewalls so tapered; so that when identical empty upper and lower crates are stacked with each of the support members of the lower crate in said second position, the base of the lower crate is spaced from the floor of the upper crate by a height substantially equal to the height of said rim.

2. A crate as recited in claim 1 wherein said crate has four feet at the bottom of said base, and positioned with respect to said base so as to cooperate with the four support members of a lower crate when said support members are in said first position and said crate is atop said lower crate.

3. A crate as recited in claim 1 wherein said base has a plurality of feet at the bottom thereof, and wherein said feet are positioned and dimensioned, and said support members are positioned and dimensioned, so that said feet and support members in said first position of stacked crates engage each other, with said support members supporting said feet.

* * * * *